US005692835A

United States Patent [19]

Krajeski

[11] Patent Number: 5,692,835

[45] Date of Patent: Dec. 2, 1997

[54] INTEGRAL BAG AND CLOSURE DEVICE

[76] Inventor: Cary C. Krajeski, 2855 So. Pullman, Santa Ana, Calif. 92705

[21] Appl. No.: 605,450

[22] Filed: Feb. 26, 1996

[51] Int. Cl.[6] ..... B65D 33/02; B65D 33/14

[52] U.S. Cl. ..... 383/22; 150/900; 383/43; 383/89; 383/905

[58] Field of Search ..... 383/43, 22, 23, 383/24, 12, 89, 905; 150/900

[56] References Cited

U.S. PATENT DOCUMENTS

| | | | |
|---|---|---|---|
| 892,330 | 6/1908 | Tavis | 383/905 |
| 1,133,831 | 3/1915 | Willoughby | 383/43 |
| 1,185,695 | 6/1916 | Marshall | 383/43 |
| 1,190,935 | 7/1916 | Minor | 383/43 |
| 1,282,761 | 10/1918 | Combes | 383/43 |
| 1,875,919 | 9/1932 | Eynon et al. | 383/89 |
| 2,043,929 | 6/1936 | Cowley | 383/905 |
| 2,202,880 | 6/1940 | Wentz | 383/905 |
| 4,050,468 | 9/1977 | Wynnyk | 383/43 |
| 4,051,994 | 10/1977 | Donk et al. | 383/905 |
| 4,810,103 | 3/1989 | Bell | 383/905 |
| 5,328,436 | 7/1994 | Larsen et al. | 383/905 |

*Primary Examiner*—Stephen P. Garbe
*Attorney, Agent, or Firm*—Roger A. Marrs

[57] ABSTRACT

A bag is disclosed herein having a pair of flexible sheets joined about their peripheral edges to define an interior storage compartment and which includes an entrance or mouth leading into the storage compartment. A length or strip of deformable material such as wire is carried on the sheets adjacent to the mouth for selectively closing the entrance subsequent to the initial bag opening or for maintaining the bag in open position when desired. The deformable element or material may be a continuous strip which extends across the sheets at the mouth of the bag or may be trained about a convoluted path across the sheets and sides of the bag adjacent to the mouth. In one form, integral end tabs protrude beyond the bag sides at the ends of the bag mouth to effect closure.

3 Claims, 1 Drawing Sheet

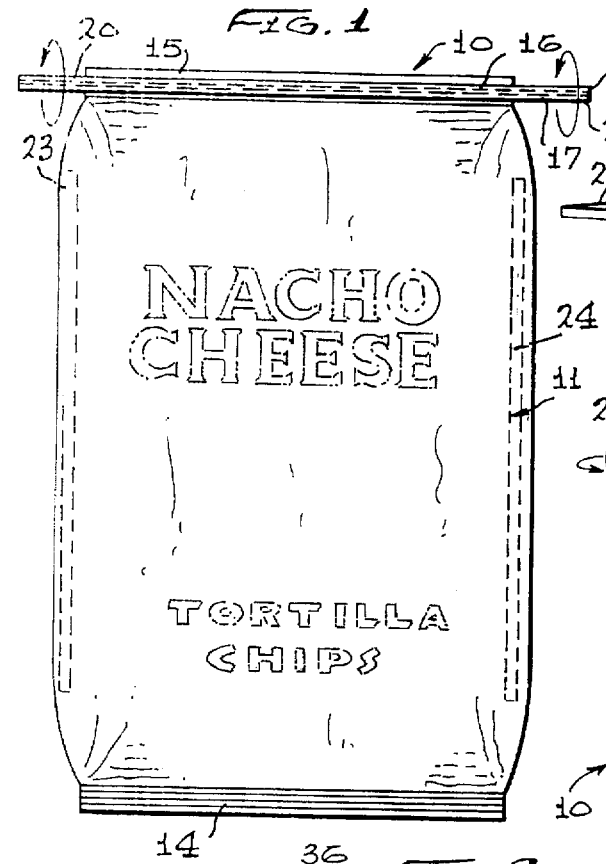
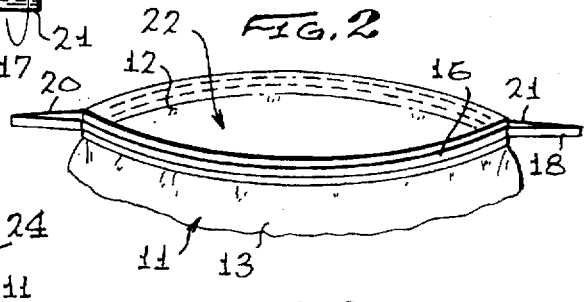
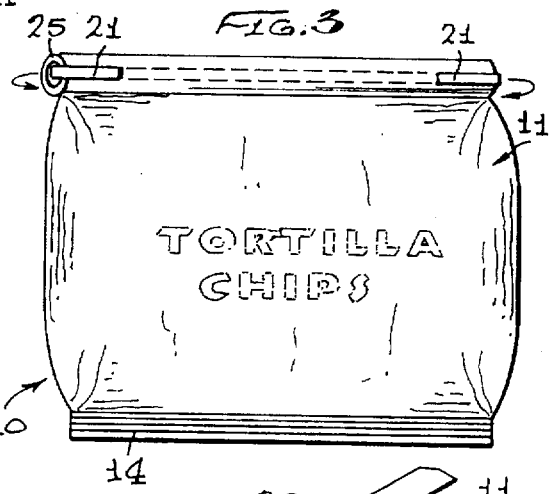
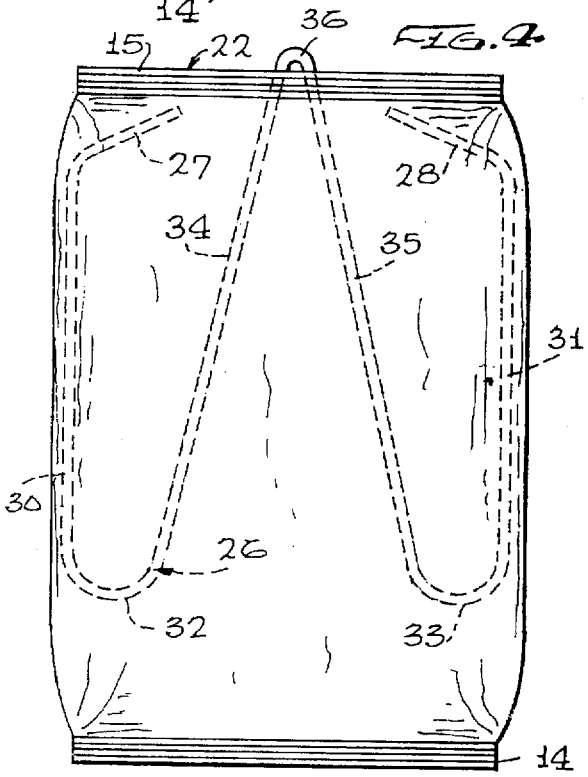
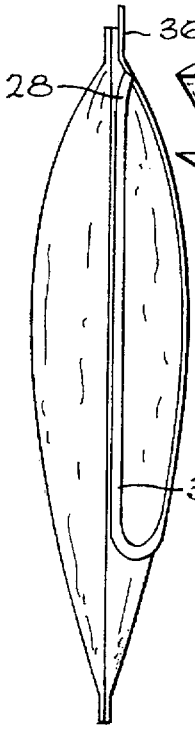
FIG. 5
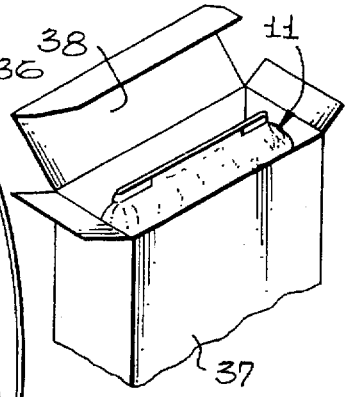
FIG. 6

INTEGRAL BAG AND CLOSURE DEVICE

BACKGROUND OF THE INVENTION

1. Field of the Invention

The present invention relates to the field of bag closures, and more particularly to a novel integral closure carried adjacent to the mouth of the bag wherein a deformable element maintains the bag in either an open mouth position or in a folded and closed position, and wherein the positions are determined after initial opening of the bag by the user.

2. Brief Description of the Prior Art

It has been the conventional practice to place confectionary items, such as potato chips, peanuts or the like, in a plastic bag and wherein the bag is closed by heat sealing an entrance or mouth leading into the internal storage compartment. The food product is sold in this manner and the user opens the bag to withdraw the contents by destroying the heat seal at the mouth or entrance to the storage compartment of the bag. Conventionally, the bag is composed of a thin and flexible plastic or plastic-like material which has a memory so that when the user desires to keep the mouth open, the material of the bag tends to close the mouth. Also, when the user intends to close the mouth of the bag with only a portion of the contents withdrawn, the user folds or rolls the top portion of the bag over upon itself to close the entrance or mouth into the storage compartment. However, problems and difficulties have been encountered which stem largely from the fact that the mouth of the bag will not be maintained open for use after the initial seal or closure has been broken and the material of the bag will not maintain itself in a folded or rolled over condition when only a portion of the contents has been removed.

Some attempts have been made to provide a secondary closure for such bags which include separate or individual ties represented by wire, strings or elastic bands which may be wrapped around the folded portion of the bag to maintain the bag closed. In some instances, separate and individual oversized plastic clips are used to hold the folded portion of the bag in the closure position. With respect to maintaining the bag open during use, devices such as expanding elements or springs have been used for trash bags and the like. However, these items are individual and separate from the bag and do not form a part of the bag itself. Thus, separate and individual closing devices are expensive and are easily lost by the user so that such devices are ineffectual.

Some attempts have been made to provide closure devices which are set forth in U.S. Pat. No. 4,932,790 as well as U.S. Pat. No. 4,562,027. Separate ties are shown in U.S. Pat. No. 4,850,486 which suggests the use of separate bag and ties but do not suggest incorporating the tie directly into the material of the bag.

Therefore, a long-standing need has existed to provide a novel combined and integral bag closure device which is carried adjacent to or in close proximity to the mouth of the bag and which can be deformed in a manner to either maintain the bag open or to maintain the bag in a closed condition. Such a closure device must be suitable for incorporation into the material of the bag for repeated use.

SUMMARY OF THE INVENTION

Accordingly, the above problems and difficulties are avoided by the present invention which provides a novel deformable strip which incorporates an internal memory so that the mouth of the bag leading into an internal storage compartment can be either maintained in an open position or in a closed position by deforming the strip or element adjacent thereto. In one form of the invention, the deformable strip may be placed across both sides of the entrance leading into the storage compartment of the bag and may include the tab at opposite ends that may be bent over upon themselves to maintain a fold of the bag material in a temporary sealed position. In another form of the invention, the deformable strip may be placed in a tortuous path across the portion of the bag adjacent to the mouth thereof which includes side portions as well as an integral hook that extends outwardly from the upper edge of the bag serving as a mounting means for the bag. In either form, the bag includes deformable strips on the opposite sides and across the top of the bag adjacent to the mouth.

Therefore, it is among the primary objects of the present invention to provide a novel closing means for a storage bag that is embedded into the treated paper of the bag, whether it be of a fiber composition or plastic composition, that will maintain the bag open or closed at the desire of the user.

Another object of the present invention is to provide a novel closure for a bag whereby, after initial opening, the bag may be closed by-rolling the bag over upon itself and retaining the bag in the folded or closed position by deformable element means.

Yet another object of the present invention is to provide a novel means for holding the bag open after the initial opening so that the user may have ready access to the contents of the bag.

A further object of the present invention is to provide a novel means for holding the mouth of the bag either open or in a folded closed position by means of a deformable strip or member that is distorted by the user into either of its open or closed positions.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front elevational view of the novel bag closure incorporating the present invention;

FIG. 2 is a front perspective view of the bag shown in FIG. 1 wherein the mouth of the bag has been opened so as to provide access to the interior thereof;

FIG. 3 is a front elevational view of the bag shown in FIG. 1 having the top of the bag folded over upon itself and closed by deforming the pliable closure element so as to maintain the entrance or mouth to the interior compartment closed;

FIG. 4 is a view similar to the view of FIG. 1 illustrating another version of the present invention which also incorporates a mounting hook;

FIG. 5 is a side elevational view of the closure device shown in FIG. 4; and

FIG. 6 is a fragmentary view of an open box into which the bag and closure device of the present invention is carried.

DESCRIPTION OF THE PREFERRED EMBODIMENT

Referring to FIG. 1, the novel integral bag closure of the present invention is indicated in the general direction of arrow 10 which illustrates a bag 11. The bag is formed conventionally as a tubular body which, in flattened state, defines two sides 12 and 13, as shown in FIG. 2. The bag is generally produced as an extrusion where a particular length is severed and joined such as by heat sealing techniques to provide a bottom closure as indicated by numeral 14. Between the opposing surfaces of the sides 12 and 13, a storage compartment is defined into which food products, such as pretzels, potato chips, nuts or the like, may be placed. The end of the bag opposite from the closed end 14 is generally closed by heat sealing techniques and such a closure is indicated by numeral 15 which effectively seals the internal compartment and its contents. The material of the bag may be of any conventional composition, such as plastic or plastic-like composition. Such plastic or extruded plastic-like bags are manufactured in a completely mechanical and automated form. Usually, the manufacturing process starts out as a reel of tubular material which is successfully die-cut and welded or heat sealed to provide the final form, or such final form is obtained when applying, also mechanically, other items, such as the inventive closure means of the present invention.

In one form of the invention, the novel closure means is integral with the material of the bag and may be applied thereto by adhesive or heat seal means so that the closure is attached to the material of the bag. Preferably, the closure means or element is affixed to the bag externally so as not to contaminate or come into contact with the contents in the storage compartment. As illustrated, the closure means includes an elongated continuous strip 16 having a deformable or pliable element 17 carried on a base member 18. The element 17 may take the form of a bendable wire while the base member may be of a plastic or paper-like composition. It is important to note that the strip 16 is elongated having opposite ends 20 and 21 which form tabs that outwardly extend from opposite sides of the bag immediately adjacent to the mouth of the bag generally illustrated by numeral 22. The mouth is illustrated in its closed position in FIG. 1; however, FIG. 2 illustrates the mouth 22 in its open position.

Preferably, the strip 16 is placed or carried on each of the respective side sheets of the bag so that a strip appears on opposite sides of the mouth 22. It is also to be noted that the opposite sides of the bag 11 include elongated strips 23 and 24 which are similar to the strip 16 in that a deformable or pliable element is carried on a base member and is integrally formed with the material of sheet 13.

Referring now to FIG. 2, it can be seen that when the mouth 22 is opened by the user from its initial closed position, the deformable elements 18 and the respective strips 16 can be pushed together at the opposite side ends of the bag and since the elements are deformable, the mouth 22 will be held open so that the user may have access to the interior storage compartment. For added retention to maintain the mouth open, the tabs 20 and 21 may be pinched to further give deformation to the element for maintaining the mouth open.

However, when the user has removed some of the contents from the storage compartment and has left an amount remaining therein which needs to be sealed, the top of the bag 11 is rolled towards the closed end 14, as shown in FIG. 3, so that the upper portion of the bag is folded over upon itself. In order to maintain the seal defined by the rolled material, the tabs 20 and 21 are now folded over the fold of material, as indicated by numeral 25, so that the roll is maintained in position. To further assist in the sealing of the roll 25, the side deformable elements 23 and 24 are folded and maintain their folded position until unrolled by the user.

It is again emphasized that the deformable strips 16, 23 and 24 are integral with the material of the bag and are not separately brought into contact with the bag by the user.

Referring now in detail to FIGS. 4 and 5, another embodiment or version of the invention is illustrated wherein the deformable member includes an element composed of a pliable composition which is carried on either the inside or outside of the tubular bag material and such an element is illustrated by numeral 26. It is to be noted that the element 26 is continuous, having opposite ends 27 and 28 which project towards one another at the top of the bag adjacent to the mouth 22 from longitudinal side portions of 30 and 31. The side portions 30 and 31 terminate in curved or arcuate portions 32 and 33 which are joined with angular portions 34 and 35 that converge across the central area of the bag to join in an external loop 36. The loop 36 projects externally and outwardly from the mouth 22 and its initially sealed arrangement 15 so that the hook may be mounted onto a rod carried on a stand on the counter for display and marketing purposes. After opening of the seal 15 so that the mouth 22 is available for entrance into the storage compartment, the portions 27 and 28 of the deformable or pliable element 26 can be flexed to maintain the mouth in its open position substantially as shown in FIG. 2. However, when it is desired to partially close the upper portion of the bag, the upper portion may be folded in a manner previously described and as shown in FIG. 3 so that the deformable or pliable element portions 30, 31, 34 and 35 are folded over upon themselves within the roll so that the roll is maintained in position and will not have a tendency to unroll.

Referring now in detail to FIG. 6, the bag 11 is illustrated as being carried in a box 37 wherein the lid 38 is illustrated in an open position so as to reveal a cereal container or the like therein. Therefore, it can be seen that the closure device and bag combination disclosed herein may be used separately or may be used in combination with a box.

In view of the foregoing, it can be seen that the novel closure and bag combination will not only be useful in maintaining the mouth of the bag open for access by the user when desired or, if desired, the user can roll down the top of the bag and may retain the fold of the bag closed and in a sealing condition by either use of tabs 20 and 21 or by means of the deformable element 26 and its various portions.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A bag and closure device comprising:

an extruded plastic bag having a width and a length being provided with a mouth leading into an internal storage compartment;

a deformable and pliable closure strip located within the bag and secured to said bag across said bag width and having opposite ends close to said bag mouth;

said deformable and pliable closure strip further having a midsection between said opposite ends extending across said bag length and said bag width;

said deformable and pliable closure adapted to selectively retain said bag mouth in an open position communicating said storage compartment exteriorly of said bag or in a closed and sealed position as said bag mouth is folded over upon itself; and said midsection length being of a V-shaped configuration having its apex outwardly projecting through said bag mouth beyond said bag.

2. The invention as defined in claim 1 wherein:

said deformable and pliable closure further including a pair of straight segments separated by said V-shaped midsection joining said opposite ends therewith.

3. The invention as defined in claim 2 including:

an arcuate segment interconnecting each straight segment of said pair to said V-shaped midsection.

* * * * *